United States Patent [19]

Goodman

[11] Patent Number: 4,598,971

[45] Date of Patent: Jul. 8, 1986

[54] BATTERY CABLE/CONNECTOR ASSEMBLY

[75] Inventor: C. Richard Goodman, Glendale, Ariz.

[73] Assignees: Raymond A. Dufresne; Terry R. Eberts; Matthew L. Ajeman; Herbert E. Haynes, Jr., all of Phoenix, Ariz.

[21] Appl. No.: 718,561

[22] Filed: Apr. 1, 1985

[51] Int. Cl.[4] ..... H01R 11/26

[52] U.S. Cl. ..... 339/228; 339/224

[58] Field of Search ..... 339/224, 227, 228, 238, 339/240, 273 R, 273 F

[56] References Cited

U.S. PATENT DOCUMENTS 4,372,636 2/1983 Dufresne ..... 339/225

4,521,067 6/1985 Dufresne ..... 339/228

*Primary Examiner*—Gil Weidenfeld

*Assistant Examiner*—Paula A. Austin

*Attorney, Agent, or Firm*—Herbert E. Haynes, Jr.

[57] ABSTRACT

A battery cable having an especially configured lug on one end is provided with a connector cap and retainer ring that exert a circumferentially applied force on a contact portion of the lug to form and hold the contact portion of the lug in direct electrically conductive contact with the terminal post of an electric storage battery.

15 Claims, 8 Drawing Figures

BATTERY CABLE/CONNECTOR ASSEMBLY

BACKGROUND OF THE INVENTION

1. Field of the Invention

This invention relates to battery cable connectors and more particularly to an improved battery cable connector for demountably attaching a battery cable to the terminal post of an electric storage battery.

2. Description of the Prior Art

Most electric storage batteries of the type used in association with generators or alternators driven by internal combustion engines for supplying electric current to starters, and other accessories of the engine and to, for example, the various electrical components of an automotive vehicle are provided with tapered positive and negative terminal posts to which the required cables are clampingly attached. For many years, the clamping attachment of the battery cables has been accomplished by a split clamp formed of lead due to the inherent resistance of lead to acid induced deterioration. Briefly, this well known split clamp includes the lead body having a tapered hole formed therethrough to axially receive the battery terminal post, and the lead body is split radially of the tapered hole to provide a pair of spaced ears. A cross-bore is formed transversely through the spaced ears for receiving an adjusting bolt which, in conjunction with a suitable nut, applies a squeezing pressure on the ears to reduce the internal diameter of the tapered hole for clamping engagement with the battery terminal post. The cable is attached to the lead body so that conductive contact between the conductors of the cable and the terminal post of the battery is made through the lead body of the split clamp.

The above described split lead clamp has been one of the most troublesome devices on an automotive vehicle both from mechanical and electrical standpoints. Since lead is a relatively soft metal, it is easily stretched or otherwise deformed and is easily fatigued, and as a result, these prior art clamps cannot tolerate much in the way of abuse which normally occurs when installing, removing and reinstalling the clamps.

When these split battery clamps become stretched, to the extend where the ears are touching each other, the clamp loses its clamping ability and loose connections result. Oftentimes the ears of the clamp will become deformed making it very difficult to tighten or loosen the adjusting bolt which can result in several problems. When the bolt cannot be properly tightened, loose connections result, and when the bolt cannot be loosened it can become extremely difficult to remove the clamp and batteries have been ruined by loosening or breaking of the terminal post resulting from attempts to remove a tight clamp. Deformed ears have all too often resulted in rounding of the nut and the head of the bolt and stripping of the threads.

Since the adjusting bolt and its associated nut cannot be made of lead, and must be formed of a harder metal, they are subject to acid induced deterioration and become heavily corroded which weakens them and also results in loosening and tightening problems.

In addition to the above mentioned and other mechanical problems of the prior art split battery clamps, they are also subject to electrical problems. A loose connection, of course, results in an increase in the resistance of the electrical circuit and a consequent loss of power to the starter and other accessories. Even a clamp which appears to be tight can produce problems in that a corrosion build-up can occur between the terminal post and the internal surfaces of the clamp, and such corrosion will increase the resistance to current flow and in severe cases has been known to result in complete interruption of current flow in the circuit.

The above described problems and shortcomings with the traditional lead battery clamps have long been known, and the art is replete with various types of clamping arrangements which attempted to solve, or a least reduce some of these problems.

One prior art patent in particular, U.S. Pat. No. 4,372,636, issued on Feb. 8, 1983, to Raymond A. Dufresne, disclosed a cap-shaped connector body of inert dielectric material, such as plastic, and a blind bore is formed axially therein. The exposed strands at the end of a battery cable, which were bent at a right angle and flared outwardly, are introduced into the open end of the blind bore of the connector body then forced axially onto a battery terminal post. Then, a ring, or cap structure was, in turn, forced axially onto the body to clampingly hold the connector body on the terminal post. In this manner, the connector structure of the Dufresne patent forms a direct pressure connection between the battery terminal post and the exposed strands of the battery cable, and the connection is made with inert dielectric materials which made a substantially improved connection with regard to the access of corrosion producing acid fumes and air.

The structure of the Dufresne patent was not without some shortcomings. First, the exposed and flared strands of the battery cable can become bent, entangled, or otherwise deformed, particularly as a result of repeated removals and installations, and if this occurs, reinstallation can become difficult if not impossible. Secondly, the exposed strands of the battery cable can become corroded as a result of acid attack, and it is difficult to properly clean away the corrosion from the multiple strands. Thirdly, when the Dufresne clamping structure is attached to the terminal post of a battery, the conductive strands are completely covered by the connector body and the retainer cap. Therefore, connecting an auxiliary clamp thereto for the purpose of jump-starting, battery charging, and the like, cannot be accomplished. And lastly, no manner of attaching the battery cable to the Dufresne connector structure for ease of handling is disclosed.

Therefore, a need exists for a new and improved battery cable and connector assembly for attaching battery cables to the terminal posts of electric storage batteries, with this connector overcoming some of the problems and drawbacks of the prior art.

SUMMARY OF THE INVENTION

In accordance with the present invention, a new and improved connector is disclosed for connecting a battery cable to the terminal post of a battery. The electrically conductive strands, that have the insulation removed, at the extending end of a battery cable are encased, or encapsulated in a lug of relatively soft, or malleable, electrically conductive metal. The lug is bent or otherwise formed into a substantially right angle, and the bent over extending end thereof is located in the blind bore provided in a clamping cap means. The clamping cap means is configured so that it will provide an interference fit when the cap, having the bent over end of the lug in its bore, is pushed axially onto the battery terminal post. A retaining ring is coaxially pushed onto the periphery of the clamping cap to firmly, but demountably, hold the clamping cap on the terminal post and thereby provide a pressurized electrically conductive connection between the lug and the terminal post.

Both the clamping cap and the retainer ring are formed of inert dielectric materials, such as nylon, hard rubber, or any suitable synthetic resin, so that the clamping force is accomplished by means of a structure that cannot corrode as a result of the acid environment in which it is used, and thus, the cable connector assembly per se cannot contribute to the failure of the connection as a result of acid induced deterioration. In that the electrically conductive strands of the battery cable are encapsulated in the metal lug, they are protected from deformation and corrosion. Further, means are provided for attaching the clamping cap to the strand encapsulating lug for ease of handling, and the lug extends from the clamping cap to allow temporary connections to be made for the purpose of jump starting, battery charging, and the like.

Accordingly, it is an object of the present invention to provide a new and improved battery cable with a clamping assembly.

Another object of the present invention is to provide a new and improved battery cable with a clamping assembly wherein the clamping force is applied by a connector structure that is formed of resilient inert dielectric material so that the connector structure cannot contribute to the connection failure as a result of acid induced deterioration.

Another object of the present invention is to provide a new and improved battery cable with a clamping assembly of the above described character wherein the conductive strands at the end of a battery cable are encapsulated in a relatively soft, or malleable metallic lug which is pressure connected directly to the battery terminal post by the inert dielectric connector assembly.

Still another object of the present invention is to provide a new and improved battery cable with a clamping assembly of the above described type wherein the electrically conductive lug is connected to the inert dielectric connector assembly for ease of handling.

Yet another object of the present invention is to provide a new and improved battery cable with a clamping assembly of the above described character wherein the electrically conductive lug extends from the inert dielectric connector assembly to permit temporary attachment of an auxiliary clamp for jump-starting, battery charging, and the like.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
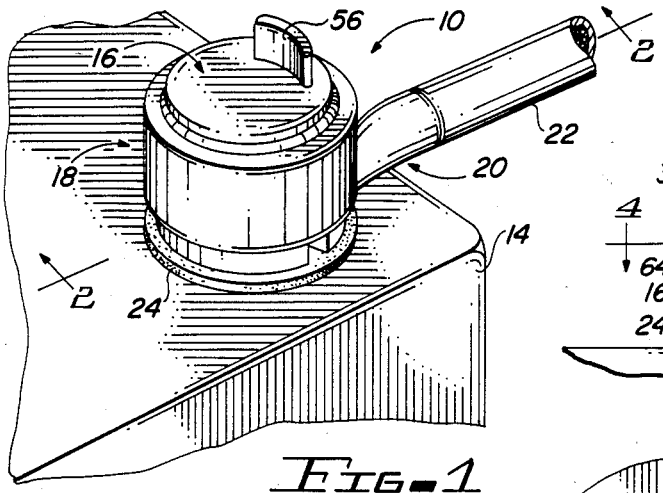
FIG. 1 is a fragmentary perspective view of a portion of a typical electric storage battery having the battery cable/clamping assembly of the present invention mounted thereon.

Referring more particularly to the drawings, FIG. 1 best shows the battery cable/clamping assembly of the present invention, which is indicated in its entirety by the reference numeral 10, and is shown as being mounted on the terminal post 12 (FIG.3) of a typical electric storage battery 14 of the type commonly used, for example, in automotive vehicles.

As will hereinafter be described in detail, the battery cable/clamping assembly 10 includes a clamping cap means 16 and a retainer ring means 18 which cooperatively connect an especially configured lug 20 of a battery cable 22 to the battery's terminal post 12. The assembly 10 also preferably includes a sealing washer 24 of a well known conventional type.

The clamping cap means 16 is preferably of cylindrical configuration with a blind bore 26 formed axially therein. The sidewall of the cap means 16 is formed with a pair of diametrically opposed slits 28 which extend axially from the edge 30, which circumscribes the opening of the blind bore 26, toward the closed top 32 of the cap means so that the slits 28 divide the sidewall of the cap into an opposed pair of semi-circular in cross section legs 34 and 36. The leg 36 is provided with a notch means 38 formed in the lower edge 30 of the cap so that the special lug 20 of the cable 22 can be introduced into the bore 26 of the cap 16 and a cable attachment means 40 is formed in the notch means 38 as will hereinafter be described in detail.

The clamping cap means 16 is preferably further provided with an annular bead 42 on the periphery thereof proximate the closed top 32, and an arcuate slot 44 may be formed through the closed top into the blind bore 26. The purposes for the annular bead 42 and the arcuate slot 44 will become apparent as this description progresses.

Figure 5:
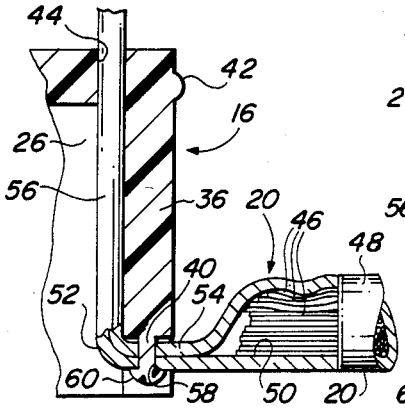
FIG. 5 is a fragmentary sectional view similar to FIG. 2 which is enlarged and partially broken away to illustrate a first embodiment of the battery cable construction and connection thereof to the cable clamp.

The battery cable 22 is of the type commonly used in the automotive art and therefore is provided with a plurality of electrically conductive wires, or strands 46, enclosed in a suitable insulative cover 48. To prepare the battery cable 22 for use with the connector assembly, the insulative cover 48 is removed to expose the conductive strands 46 at the terminal end of the cable 22. The exposed strands 46 are then encased in the special lug 20. In this first embodiment, the lug 20 is of tubular configuration defining an axially extending end having a bore 50 into which the exposed strands 46 of the cable are axially inserted as shown in FIG. 5. The inserted strands 46 are fixedly secured in the bore 50 of the lug 20 such as by soldering, welding, or crimping of the lug, of any other suitable manner which forms a good electrically conductive contact between the lug 20 and the strands 46. The extending end of the lug is flattened and bent as at 52 into a substantially right angle to provide a flat intermediate portion 54 and a contact portion 56. The lug 20 may be provided with a transverse aperture 58 which is drilled or otherwise formed in the flat intermediate portion 54 thereof.

The lug 20 is formed of a relatively soft, or malleable, electrically conductive metal such as copper, brass, lead alloy, or the like.

Figure 2:
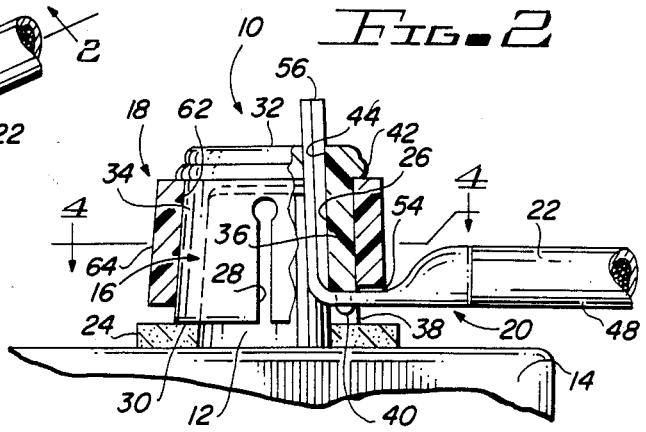
FIG. 2 is an enlarged sectional view taken along the line 2—2 of FIG. 1.
Figure 4:
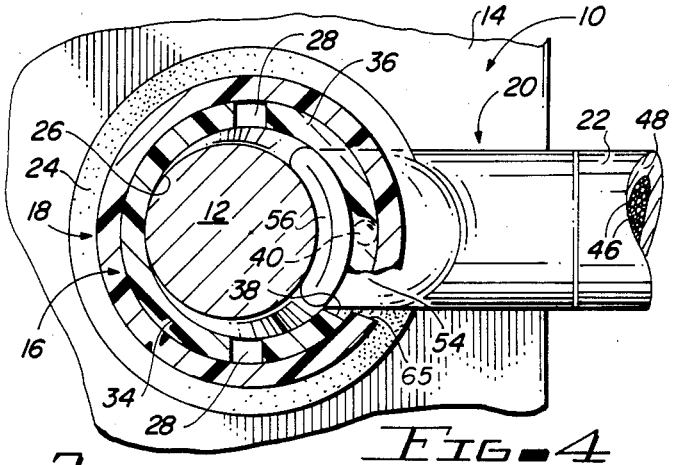
FIG. 4 is an enlarged sectional view taken long the line 4—4 of FIG 2.

The battery cable 22 is fixedly attached to the clamping cap means 16 by locating the flat intermediate portion 54 thereof so that it is located in the notch means 38 provided in the lower edge 30 of the leg 36. In this position, the contact portion 56 of the lug 20 extends upwardly within the blind bore 26 of the clamping cap 16, and may, if desired, extend through the arcuate slot 44 provided in the closed top 32 of the cap. By passing through the top of the cap 16 in this manner, the contact portion 56 of the lug will provide an extending end, as seen best in FIGS. 1 and 2, so that a temporary connection can be made by an auxiliary clamp (not shown) for the purpose of jump-starting, battery charging, and the like. It will be noted, however, that providing the arcuate slot 44 and the extending end of the contact portion 56 of the lug 20 is not critical in that temporary connections can be made on the radially extending tubular end of the lug 20. In this case, therefore, the contact portion 56 of the lug 20 will be shorter than illustrated so that it is located entirely within the blind bore 26 of the clamping cap means 16.

As shown, the contact portion 56 of the lug 20 is of arcuate cross section so that it convex surface is in contiguous engagement with the bore 26 of the clamping cap 16 and its concave surface is in contiguous engagement with the periphery of the battery terminal post 12 when the battery cable/clamp assembly is mounted thereon.

The cable attachment means 40 provided on this first embodiment of the clamping cap means 16 is in the form of a cylindrical rod or post which extends integrally from the sidewall leg 36 of the cap into the notch means 38 thereof. When the battery cable 22 is assembled to the clamping cap means 16 in the hereinbefore described manner, the attachment rod 40 extends through the transverse aperture 58 of the flat intermediate portion 54 of the special lug 20 and the extending end of the attachment rod 40 is formed into a flattened head 60, much in the manner of a rivet, to fixedly interconnect the clamping cap and the battery cable. As will hereinafter be described, the clamping cap means 16 is formed of a material having special characteristics which allows the head 60 to be formed by, for example, a heating operation.

When the battery 22 and clamping cap 16 are connected together in the manner described above, installation on the battery terminal post 12 is accomplished by axially pushing the cap onto the post. The blind bore 26 of the cap 16 is sized so that with the contact portion 56 of the lug 20 disposed therein, an interference fit with the terminal post 12 results in deflection of the legs 34 and 36 somewhat, and the natural resiliency of the cap 16, as will hereinafter be described, will exert a counteracting force which firmly forces and holds the contact portion 56 in electrically conductive contact with the terminal post.

When the cap 16 is being pushed onto the terminal post 12, the concave surface of the contact portion 56 of the lug 20 will slide axially along the peripheral surface of the terminal post. This sliding action accomplishes what is sometimes referred to as a wiping action which cleans and reduces surface irregularities in the juxtaposed surfaces of both the post and the contact portion 56 of the lug. This wiping action produces a far superior electrical contact than can be made by a simple clamp-on connection, such as is made by the traditional lead type battery clamps (not shown), in that the connection made by the wiping action is substantially gas tight, i.e., smooth contacting surfaces, and this reduces the occurrence of corrosion build-up between the two surfaces by limiting the access of acid, acid fumes, and air.

The material of which the clamping cap 16 is fabricated may, of course, be metal, but the preferred material is an electrically insulative and inert material in order to resist the corrosion and otherwise deteriorating effects of the very hostile environment associated with the battery 14. In addition, the material should resist creep, i.e., the slow change in its configuration or dimensions due to prolonged exposure to stress, and the material must also be resilient, that is, it must attempt to return to its normal position after deflection. A variety of materials are known which possess these characteristics, such as nylon, hard rubber, and a variety of materials of the synthetic resin, or plastic type.

As described above, the legs 34 and 36 of the clamping cap 16 will be deflected somewhat upon axial receipt of the battery terminal post 12 within the blind bore 26 of the cap. The retainer ring means 18 is employed to prevent excessive creeping of these resiliently deflectable legs over a prolonged period of time. The retainer ring means 18 is, as seen best in FIG. 3, preferably of cylindrical configuration with a bore 62 formed axially therethrough, with the diameter of the bore being such that it closely matches the outside diameter of the clamping cap 16. When the retainer ring means 18 is pushed axially onto the previously installed clamping cap, an interference fit results so that the ring means coaxially circumscribes the cap, the endless sidewall 64 of the retainer ring means will retainingly confine the legs 34 and 36 in place. The retainer ring means 18 is provided with a notch 65 in the lower edge of its sidewall 64 which provides clearance for the radially extending lug 20 of the battery cable 22.

In that terminal posts 12 of automotive batteries are usually tapered, the opposed legs 34 and 36 of the clamping cap 16 will, when installed, assume a similar tapered attitude. That is, the legs will diverge somewhat from the closed top 32 of the clamping cap 16 in the manner shown in FIG. 2. It has been found that this will not normally cause any problems with regard to the retainer ring means creeping axially off of the clamping cap 16 as a result of vibrations, and the like. However, to positively insure that this won't happen, the retainer ring means 18 is pushed axially over the annular bead 42 provided on the clamping cap 16, as hereinbefore described, and will snap into place below the bead during the installation operation.

In that retaining is the only function of the retainer ring means 18, about the only requirement of the material of which it is made is that the material will tenaciously resist deflection. As was the case with the clamping cap 16, the retaining ring means 18 may be formed of various materials, preferably a dielectric material such as a suitable synthetic resin which is provided, for example, with glass fibers to increase its resistance to deflection.

Figure 6:
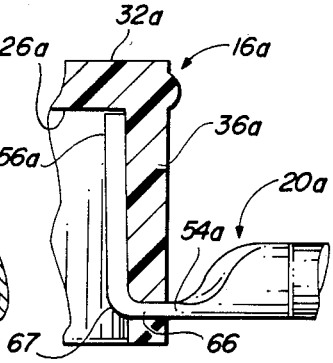
FIG. 6 is a view similar to FIG. 5 showing another way of connecting the battery cable to the clamp.

As hereinbefore mentioned, the clamping cap 16 may be formed without the arcuate slot 44 and the lug 20 may be provided with a shortened contact portion 56 which is located entirely within the blind bore 26 of the cap. With this in mind, reference is now made to FIG. 6 wherein such a configuration is shown as including a modified clamping cap 15*a* and a modified lug 20*a*. In this embodiment, the cap 16*a* is seen to be formed with a fully closed top 32*a* and is also formed with a radial slot 66 in the leg 36*a* thereof, which is used instead of the notch 38 and the cable attachment means 40 of the previously described clamping cap 16. The lug 20*a* is similar to the previously described lug with the exception of the shortened contact portion 56*a* and the absence of the transverse aperture 58 (FIG. 3) in its flat intermediate portion 54*a*. In this embodiment, the lug 20*a* is left in the un-bent state until after the contact portion 56*a* has been inserted through the slot 66 into the blind bore. After insertion, the lug 20*a* is bent as at 67 so that the contact portion will extend axially into the blind bore 26*a* in the manner hereinbefore described. Therefore, it will now be seen that the radial slot 66 of the cap 16*a* serves a dual function of allowing the contact portion 56*a* of the lug 20*a* to be introduced into the blind bore 26*a* of the clamping cap 16*a* and also provides means for connecting the clamping cap 16*a* to the battery cable 22*a*.

Figure 7:
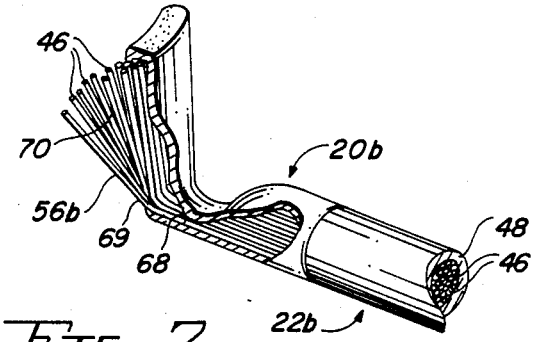
FIG. 7 is a perspective view of a modification of the terminal end of the battery cable which is partially broken away to illustrated the various features thereof.

FIG. 7 shows an alternate way of forming a lug 20*b* on the terminal end of the battery cable 22*b*. In this embodiment, the exposed electrically conductive strands 46, which extend from the cable are preformed by flattening and bending them to provide the desired flat intermediate strand portion 68 and bent as at 69 into a substantially right angle to provide the extending contact strand portion 70. The conductive strands 46 in the contact strand portion 70 are fanned out, or flared, and formed into the desired arcuate in cross section configuration. When performed into this shape, the lug 20*b* is molded around the conductive strands so as to complete encapsulate them in a protective envelope of electrically conductive metal such as lead, or a lead alloy, which defines the strand encasing tubular end, the intermediate strand encasing portion and the extending contact strand encasing portion.

Figure 3:
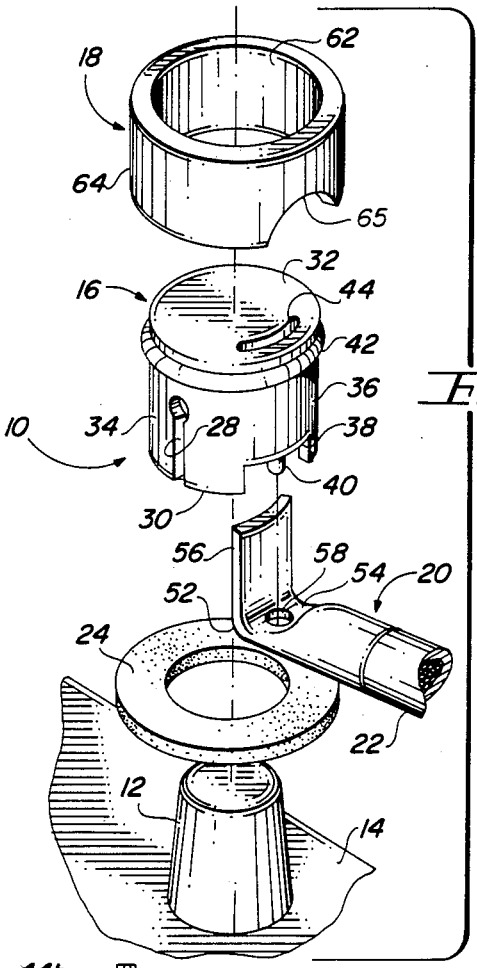
FIG. 3 is an exploded perspective view of the battery cable/clamping assembly of the present invention.

When the lug 20*b* is formed in the above described manner, it may be provided with a transverse aperture (not shown) such as that shown at 58 in FIG. 3, to enable the cable 22*b* to be attached to the cap 16 by means of the attachment rod 40 as described above. Alternately, the lug 20*b* may be inserted through the radial slot 66 of the modified clamping cap 16*a* and subsequently bent, such as by heating, so as to extend into the bore of the cap.

Although the clamping cap means 16 and 16*a* are shown and described herein as being provided with means for connecting the battery cable to the cap, it is to be understood that such connection is not absolutely necessary to the operation or function of the present invention. The lug 20 could freely pass through the notch means 38 of the cap 16 if the handling advantage of connecting the cable to the cap 16 was not needed or desired.

Figure 8:
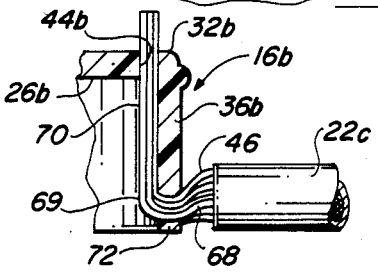
FIG. 8 is a view similar to FIG. 5 and showing yet another embodiment of the present invention.

Referring now to FIG. 8, wherein another embodiment of the present invention is shown in this embodiment, the battery cable is formed much in the same manner as hereinbefore described with reference to FIG. 7, with the exception of the lug 20*b* being omitted. Therefore, the exposed electrically conductive strands 46 are preformed to provide the flat intermediate strand portion 68 which is bent as at 69 to provide the normally extending contact strand portion 70. When preformed in this manner, the battery cable 22*c* is placed proximate the clamping cap 16*b* so that the flat intermediate portion 68 passes through a notch 72 provided in the lower edge of the leg 36*b* of the cap and the contact strand portion 70 extends upwardly in the bore 26*b* so that it passes through the arcuate slot 44*b* formed in the top 32*b* of the cap. In this manner, the preformed conductive strands 46 of the cable 22*c* are in direct conductive contact with the terminal post 12 when the battery cable/connector assembly of this embodiment is mounted on the battery 14 and the extending end of the contact strand portion 70 is presented exteriorly of the cap for temporary connection purposes.

While the principles of the invention have now been made clear in the illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A battery cable/connector assembly for mounting on a terminal post of an electric storage battery, said battery cable/connector assembly comprising:

(a) a battery cable having electrically conductive strands extending from one end thereof;

(b) a lug of electrically conductive metal encasingly fixed on the extending strands of said battery cable in electrically conductive contact therewith, said lug having an axial extending strand encasing portion and a flattened contact portion which extends angularly from the strand encasing portion;

(c) clamping cap means of inert dielectric resiliently deformable material and having a blind bore formed axially therein;

(d) said contact portion of said lug being disposed axially in the blind bore of said clamping cap means with the blind bore being sized to axially receive the terminal post of the storage battery in an interference fit manner so that said clamping cap means will provide a pressurized electrically conductive contact between the contact portion of said lug and the terminal post of the storage battery when the terminal post is received therein; and (d) retainer ring means demountably mountable on the periphery of said clamping cap means to surroundingly retain said clamping cap means in place when the terminal post of the storage battery is received in the blind bore thereof.

2. A battery cable/connector means as claimed in claim 1 and further comprising attachment means for fixedly connecting said clamping cap means to said lug.

3. A battery cable/connector assembly as claimed in claim 1 wherein said lug is formed of a relatively soft metal and the contact portion thereof is formed with a transverse arcuate in cross section configuration to provide a concave surface which closely matches the periphery of the terminal post and an opposite convex surface which closely matches the surface configuration of said clamping cap means which defines the blind bore thereof.

4. A battery cable/connector assembly as claimed in claim 1 and further comprising:

(a) said extending electrically conductive strands of said battery cable being preformed to provide a flattened intermediate strand portion in spaced relationship from the end of said battery cable, said intermediate strand portion extending substantially axially from said battery cable and bent into an approximate right angle to provide a substantially flattened angularly extending contact strand portion; and (b) said lug being of relatively soft electrically conductive material which is encapsulatingly molded on said preformed extending strands.

5. A battery cable/connector assembly as claimed in claim 1 wherein the angularly extending contact strand portion is further preformed by being in a flared array and of transversely arcuate shape.

6. A battery cable/connector assembly as claimed in claim 1 wherein said clamping cap means comprises:

(a) a top;

(b) at least an opposed pair of legs extending integrally from said top so as to surroundingly define the blind bore of said clamping cap means; and (c) notch means formed in the extending edge of one of said pair of legs for receivingly positioning said lug so that the axially extending strand encasing portion of said lug extends radially from said clamping cap means and the contact portion of said lug is disposed in the blind bore of said clamping cap means.

7. A battery cable/connector assembly as claimed in claim 6 and further comprising attachment means for fixed connection of said clamping cap means to said lug, said attachment means comprising:

(a) said lug having a flattened intermediate portion between the axially extending strand encasing portion and the contact portion thereof, said intermediate portion being disposed in said notch means and having an aperture formed therethrough; and (b) a rod extending integrally from the one of said pair of legs into said notch means and passing through the aperture formed in the intermediate portion of said lug, said rod having an enlarged head on the end thereof which extends beyond the aperture provided in the intermediate portion of said lug.

8. A battery cable/connector assembly as claimed in claim 6 and further comprising:

(a) said top of said clamping cap means having a slot formed therethrough; and (b) said contact portion of said lug extending from the blind bore of said clamping cap means through the slot formed in said top to provide an exterior temporary connection point.

9. A battery cable/connector assembly as claimed in claim 1 wherein said clamping cap means comprises:

(a) a top;

(b) at least an opposed pair of legs extending integrally from said top so as to surroundingly define the blind bore of said clamping cap means; and (c) slot means formed proximate the extending edge of one of said pair of legs for positionally holding said lug so that the axially extending strand encasing portion thereof extends radially from said clamping cap means and the contact portion of said lug is disposed in the blind bore of said clamping cap.

10. A battery cable/connector assembly as claimed in claim 9 wherein said lug is formed with a flattened intermediate portion between said axially extending strand encasing portion and said contact portion, said flattened intermediate portion being disposed in said slot means formed in said one of said pair of legs.

11. A battery cable/connector assembly as claimed in claim 1 wherein said lug is formed of a malleable metal and includes:

(a) a substantially tubular end which forms the axially extending strand encasing portion of said lug, said tubular end defining a bore in which the extending electrically conductive strands of said battery cable are disposed;

(b) means for fixedly securing the extending electrically conductive strands of said battery cable in the bore of the tubular end of said lugs;

(c) a flattened intermediate portion extending integrally from said tubular end and in substantial axial alignment therewith; and (d) a substantially flattened opposite end extending integrally and angularly from said intermediate portion to provide the contact portion of said lug.

12. A battery cable/connector assembly as claimed in claim 11 wherein said substantially flattened opposite end contact portion of said lug extends at substantially a right angle from said intermediate portion and is of transversely arcuate configuration to provide a concave surface which substantially matches the peripheral shape of the terminal post of the storage battery and to provide a convex opposite surface which substantially matches the surface shape of the bore formed in said clamping cap means.

13. A battery cable/connector assembly as claimed in claim 1 and further comprising, said clamping cap means being of substantially cylindrical configuration with a top and depending sidewall means circumscribingly defining the blind bore thereof, said clamping cap means having an annular bead on its periphery proximate the top thereof.

14. A battery cable/connector assembly as claimed in claim 13 wherein said retainer ring means is of substantially cylindrical configuration having an axial bore which is sized for axial placement on the periphery of said clamping cap means so as to provide an interference fit therewith, said retainer ring means interacting with the annular bead of said clamping cap to prevent unwanted axial displacement of said retainer ring means when it is installed on the periphery of said clamping cap means.

15. A battery cable/connector assembly for mounting a terminal post of an electric storage battery, said battery cable/connector assembly comprising:

(a) a battery cable having exposed electrically conductive strands extending from one end thereof, said exposed strands being preformed to provide a substantially flattened intermediate portion and a flattened contact portion which extends angularly from said intermediate portion;

(b) clamping cap means of inert dielectric resiliently deformable material having a blind bore one end of which is closed by a top wall, said top wall having an arcuate slot formed therethrough;

(c) said contact portion of said exposed strands being disposed axially in said blind bore of said cap means and extendingly passing through the arcuate slot of the top wall of said cap means, said blind bore being sized to axially receive the terminal post of the storage battery in an interference manner so that said clamping cap means will provide a pressurized electrically conductive contact between said contact portion of said exposed strands of said battery cable and the terminal post of the storage battery when the terminal post is received therein; and (d) retainer ring means demountably mountable on the periphery of said clamping cap means to surroundingly retain said clamping cap means in place when the terminal post of the storage battery is received in said blind bore thereof.

* * * * *